United States Patent [19]

Norman et al.

[11] Patent Number: 4,979,341

[45] Date of Patent: Dec. 25, 1990

[54] INTEGRAL EARTH ANCHOR

[75] Inventors: Richard M. Norman, Trussville; Stanley C. Garton, Pinson, both of Ala.; Edward Dziedzic, Germantown, Tenn.

[73] Assignee: Dixie Electrical Manufacturing Co., Memphis, Tenn.

[21] Appl. No.: 413,782

[22] Filed: Sep. 28, 1989

[51] Int. Cl.[5] ..... E02D 5/80

[52] U.S. Cl. ..... 52/157; 405/244; 405/258

[58] Field of Search ..... 405/259, 258, 242, 243, 405/244; 52/157; 175/385, 327, 263, 400, 399

[56] References Cited

U.S. PATENT DOCUMENTS

| | | | |
|---|---|---|---|
| 1,791,185 | 2/1931 | Birkenmaier | 52/157 |
| 2,234,907 | 3/1941 | Williams | 52/157 |
| 4,334,392 | 6/1982 | Dziedzic | 405/259 X |
| 4,742,656 | 5/1988 | Farmer | 52/157 X |

*Primary Examiner*—Dennis L. Taylor
*Attorney, Agent, or Firm*—Paul M. Denk

[57] ABSTRACT

An earth anchor (1) comprises a hub body (3) having a base plate (7). A shank (19) extends downwardly from a bottom surface (21) of the plate. The shank has a beveled lower edge (23) forming a tip (25) for penetrating the ground. A hub (9) extends upwardly from an upper surface (11) of the plate and non-drivingly engages the drive tool. A quadrilaterally formed circumferential side wall (17) extends upwardly from the outer margine of the plate. The side wall is spaced radially outwardly of the hub and forms a sleeve in which a portion of the drive tool is received. The base plate, hub, shank, and side wall are all integrally formed, preferably through forging or casting, forming a hub body of uniform strength, less subject to stress forces, and relatively tight dimensional tolerances. A blade (5) is attachable externally to the hub body.

4 Claims, 3 Drawing Sheets

INTEGRAL EARTH ANCHOR

BACKGROUND OF THE INVENTION

This invention relates generally to an earth anchor, and more particularly, to an earth anchor in which components comprising a hub body of the anchor are integrally formed to provide more uniform strength and tighter dimensional control.

There are a variety of earth anchors designed for penetration deep into the ground. Examples of these are the earth anchors disclosed in U.S. Pat. No. 4,742,656 to Farmer, which is assigned to the same assignee as the present application, in addition to the anchor shown in the U.S. Pat. No. 4,467,575 to Dziedzic. Typically, an earth anchor is formed by welding various components together to form a hub body, and then welding a blade to the body. Though effective, earth anchors made this way have certain problems. One of these problems, for example, is where the anchor design relies heavily for its integrity on the strength of the various welds. A second problem is the difficultly in being able to consistently form outer hubs on the hub body which are of uniform size, shape, and strength. The variations which result from anchor to anchor can create field use problems. Thirdly, the symmetry between inner and outer portions of the hub body are difficult to control. This is caused by heat distortion from the numerous welds required to make the body and can result in a tool fit which is too tight in some instances or too loose in others. It is considered that an earth anchor whose hub body does not require welding as the primary method of its formulation would not have these problems and would produce a better tool.

SUMMARY OF THE INVENTION

A primary object of the present invention is the development of an earth anchor in which components forming the hub body of the anchor are integrally formed generally through casting.

Another object is an integral hub body for an earth anchor having more inherent uniform strength than prior art hub bodies.

A third object of the invention is an integral hub body formed by forging, with the only weld being that of the blade of the anchor to the hub body; the size and shape of the hub body being controlled by the forge tooling as is the symmetry between various portions of the hub body.

Yet another object of the invention is an integral hub body having greater structural integrity than the prior art type earth anchors having a welded structure and which rely for their structural integrity on the strength of the furnished welds.

A further object of the invention is an integral anchor hub body having tighter dimensional tolerances than obtained in prior art hub bodies in which heat distortion from the numerous welds required to fabricate the body tend to warp the structure and significantly vary its dimensions.

Another object of the invention is the provision of an integral hub body for an earth anchor which exhibits significantly reduced stress during usage for its intended application than those stresses produced and encountered in prior art type earth anchors.

A still further object of the invention is the provision of an anchor hub body having a rounded center hub to prevent engagement between a wrench and the anchor drive point thereby reducing stress in the hub body relative to its said drive point.

Another object of the invention is an earth anchor in which the drive tip and its arranged angle to the anchor is controlled to provide soil opening for the blade and assure its penetration in compacted soils.

Briefly, the earth anchor of the present invention is for use with a drive tool for embedding the anchor within the ground. The earth anchor is designed to resist tensile or compressive forces tending to urge it from its embedded position. The anchor comprises a hub body having a base plate. A shank extends downwardly from the bottom surface of the plate and has an angular orientation with a beveled lower edge forming the drive tip for penetration within the ground. A hub extends integrally upwardly from the upper surface of the plate and is provided for connection to the drive tool. A circumferential integral side wall also extends upwardly proximate the outer peripheral margin of the plate and is spaced radially outwardly of the hub body to form a sleeve at the outer vicinity of the hub, and in which a portion of the drive tool is received. The base plate, shank, hub, and side wall are all integrally formed, through forging or casting, providing for an overall hub body of uniform strength and relatively tight dimensional tolerances, as aforesaid. Internal stresses which occur during usage are significantly reduced. A blade is attachable to the hub body, upon the exterior of the said side wall. Other objects and features will be in part apparent and in part pointed out hereinafter.

BRIEF DESCRIPTION OF THE DRAWINGS

FIG. 4A being a top view of the anchor, and FIGS. 4B and 4C being isometric views, and the stress patterns representing the stresses created when the leading edge of the anchor strikes an object such as a rock; and, FIGS. 5A, 5B and 5C respectively represent stress patterns created in an earth anchor of the present invention.

Corresponding reference characters indicate corresponding parts throughout the several views of the drawings.

DESCRIPTION OF THE PREFERRED EMBODIMENT

Figure 1:
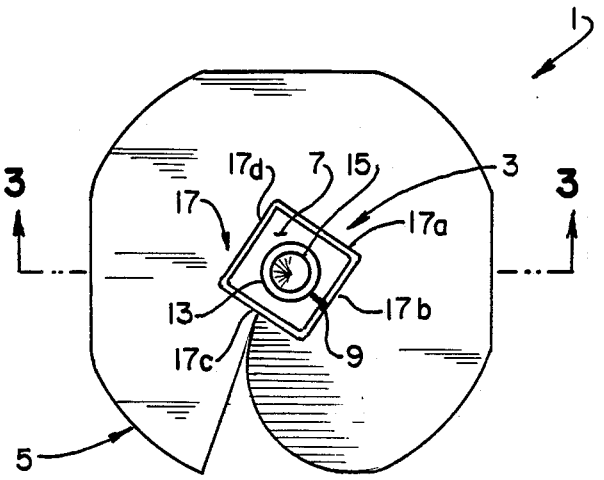
FIG. 1 is a top plan view of an integral earth anchor of the present e invention having an integral hub body with a multi-sided blade attached thereto.

Referring to the drawings, an earth anchor of the present invention is indicated generally 1. The earth anchor is for use with a drive tool (not shown) which is used to embed the anchor in the ground. The earth anchor then resists tensile or compressive forces as previously explained, which tend to urge it from its embedded position.

The earth anchor is comprised of two primary components; a hub body indicated generally at 3 and a blade indicated generally at 5. The blade is attachable to the body. Blade 5, for example, may preferably be a multi-sided blade of the type disclosed in U.S. Pat. No. 4,742,656, which is assigned to the same assignee as the present invention and application. Or, blade 5 may be of any other suitable type blade, such as those that are of a rounded and spiral design. Blade 5 is attached to the hub body in a suitable manner, usually by welding.

Hub body 3 has an integral base plate 7 which is generally rectangular in plan and may, as shown in the drawings, be square. A upper hub 9 is integrally formed within the hub body and extends vertically upwardly from an upper surface 11 of said plate 7. The upper hub is circular in cross-section and the centerline of the upper hub corresponds essentially to the centerline of the base plate (see FIG. 3). Outer end 13 of the upper hub has a bore 15 formed therein. The bore is internally threaded for accommodating an end of the anchor rod of the drive tool to be threadably received in and engaged by the upper hub. An advantage of using a round or cylindrical upper hub 9 is it assures there is no driving engagement between a wrench of the drive tool (not shown) used to attach a drive motor or auger motor to the earth anchor and this upper hub, as at the drive point of the anchor. This has been found to substantially reduce stress on the anchor.

A sidewall 17 extends upwardly proximate the outer margin of the integral base plate 7. Sidewall 17 is of a circumferential design for forming a side wall, and is also rectangular, or square, in plan and has respective sidewall sections 17*a* through 17*d*, as shown. As best seen in FIG. 1, the sidewall is spaced radially outwardly of the upper hub 9 and forms a rectangular space internally of the sleeve and in which the drive tool is received during anchor installation. The height of the side wall generally corresponds to the height of the hub, as can be readily seen.

Figure 2:
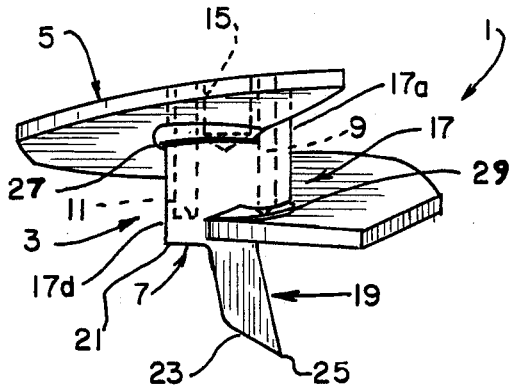
FIG. 2 is a side elevational view of the anchor.
Figure 3:
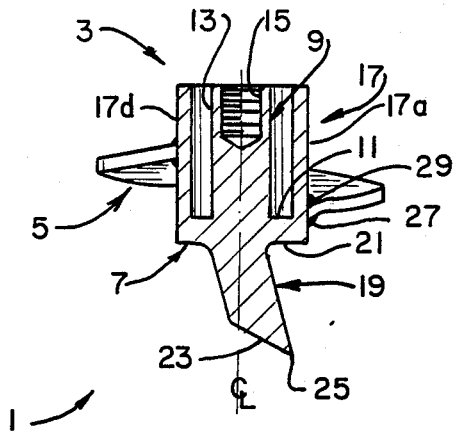
FIG. 3 is sectional view of the earth anchor taken along line 3—3 in FIG. 1.

A shank 19 (see FIG. 2, and specifically FIG. 3) is integrally formed with the hub and extends downwardly from a bottom surface 21 of plate 7. The shank has a beveled lower edge 23 forming a chisel tip 25 for penetrating the ground. As best shown in FIG. 3, shank 19 extends downwardly from base plate 7 at an angle to the centerline of the base plate. Consequently, the tip or leading edge of the shank is offset with respect to the center of the hub body. This provides clearance for the hub body to enter the soil, and provides a better grinding action for the shank to cut the ground and allow the anchor to enter into it.

Base plate 7, hub 9, side wall 17, and shank 19 are, as noted, integrally formed to create the hub body 3. Preferably, this is done by forging or casting of the hub body. This gives the hub body 3 a number of advantages over prior art earth anchors whose hub bodies are formed by welding various structural components together. For example, hub body has a uniform strength throughout the structure. Also, because there is no welding of parts, the body is more reliably made, and to closer tolerances, as previously alluded to. In addition to the improved structural integrity, the hub body has relatively tighter dimensional tolerances. Because there is no heat distortion due to welding, symmetry between hub 9 and sidewall 17 is readily and consistently assured and maintained. This assures a consistently close tolerant wrench to earth anchor fit. Also, the improved symmetry of the hub permits better centering of bore 15.

To assemble an earth anchor, blade 5 is fitted about the hub body. The blade is then welded to the outer surface of sidewall 17. As shown in FIGS. 2 and 3, a first seam 27 is continuously formed along the lower surface of the blade where it abuts the sidewall, and a second seam 29 is continuously formed along the upper surface of the blade where it abuts.

Figure 4A:
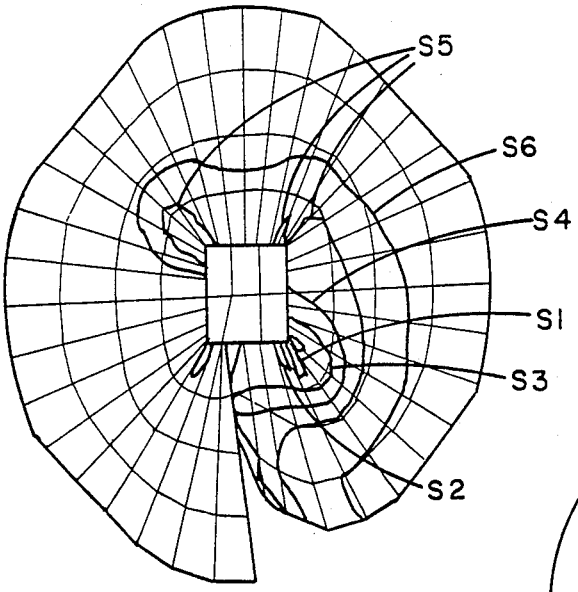
FIG. 4A. PRIOR ART
FIGS. 4A, 4B and 4C respectively represent stress patterns created in a prior art earth anchor in which its various components are connected by welding.
Figure 4B:
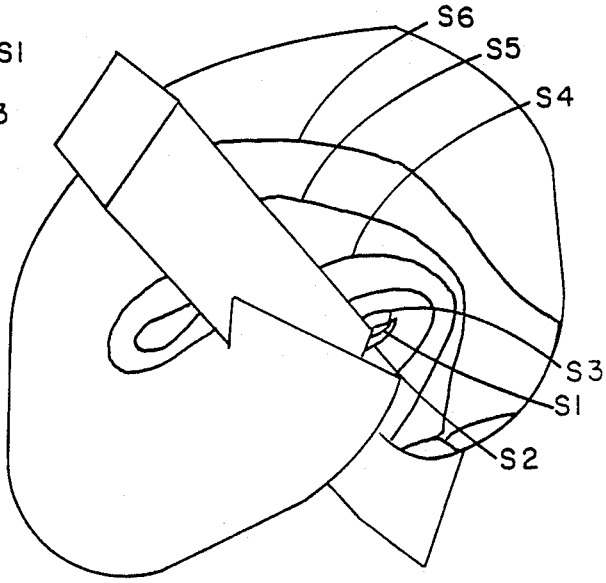
FIG. 4B. PRIOR ART
Figure 4C:
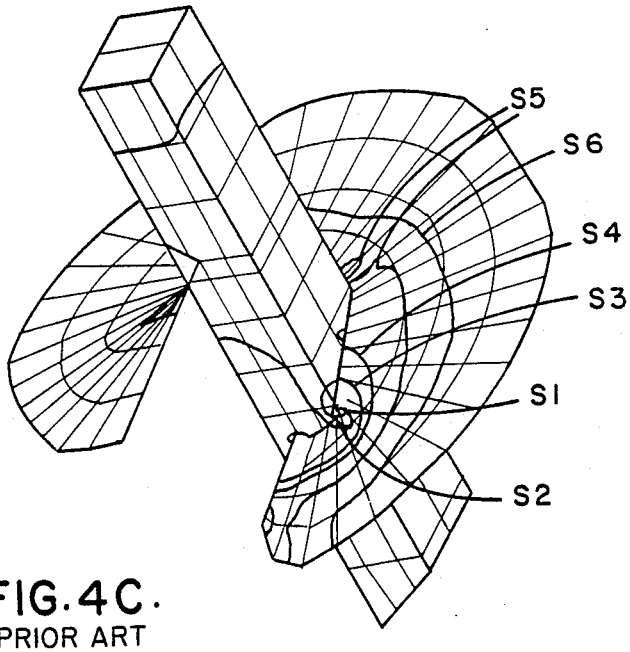
FIG. 4C. PRIOR ART

It is an important feature of the earth anchor of the present invention to have significantly reduced stresses than conventional or prior art welded earth anchors. As shown in FIGS. 4A–4C, when the leading edge of the anchor strikes a solid object such as a rock, relatively high levels of stress are produced. The stresses as generated are greatest at the corner of the hub and blade adjacent the leading edge of the blade and high levels of stress extend outward along the leading edge of the blade and around the perimeter of the hub. The highest area of stress is indicated by the stress line S1 and the gradually lessening lines of stress by stress lines S2–S6.

Figure 5A:
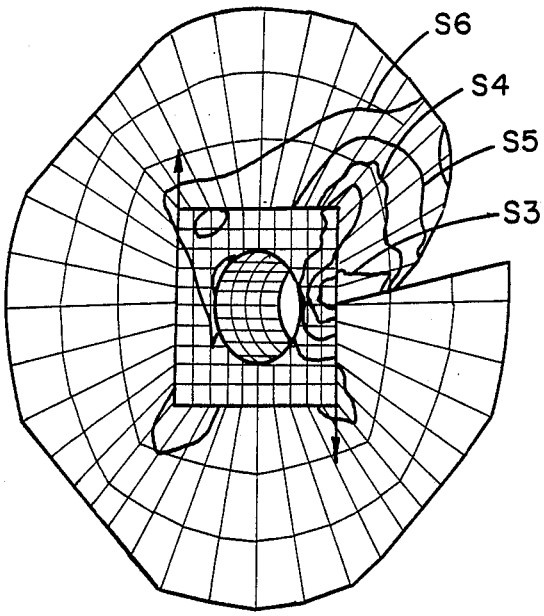
FIG. 5A being a top view, FIG. 5B a bottom view; and, FIG. 5C an isometric view, with the stress patterns representing the stresses created when the leading edge of the anchor strikes an object such as a rock.
Figure 5B:
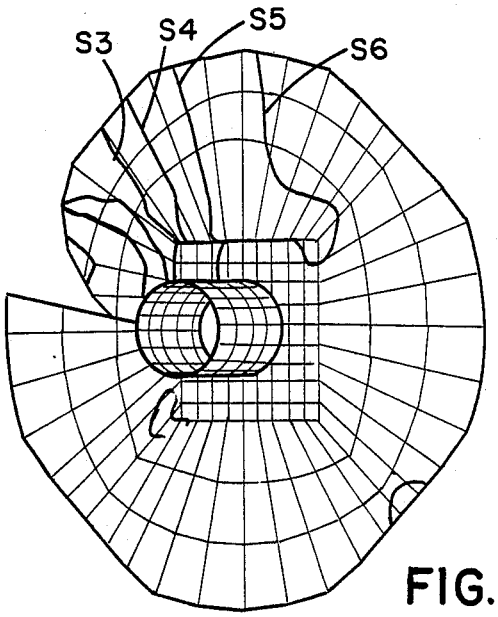
Figure 5C:
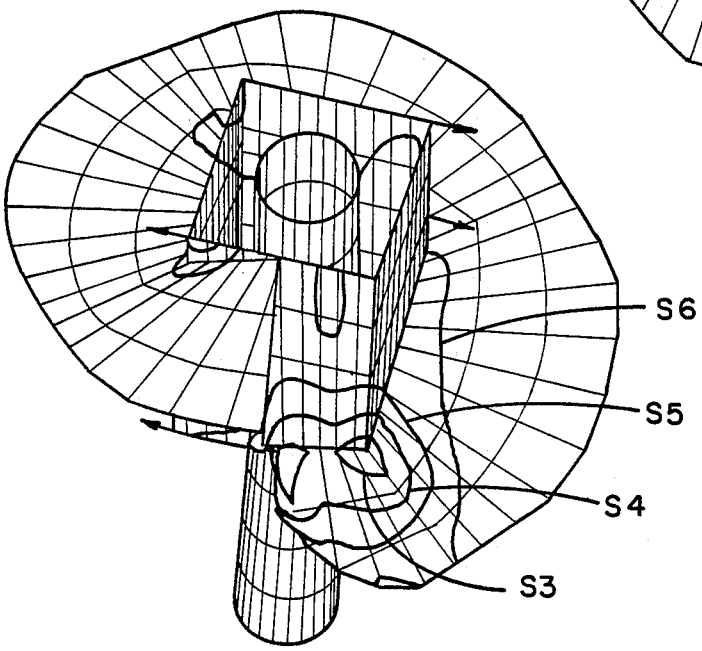

In contrast to the amount of stress to which the aforesaid conventional earth anchor is subjected, the earth anchor of the present invention, with its integrally formed hub assembly, is subject to substantially less stress. As shown in FIGS. 5A–5C, these stress levels correspond in intensity only to that represented by the stress lines S3–S6 in these Figures. Intensive stress lines, corresponding to stresses shown at 51 and 52 are not generated in the inventive anchor. Furthermore, the area of the earth anchor subject to stress is much smaller than that of the conventional earth anchor. Consequently, earth anchor 1 is less prone to failure and maintenance and replacement costs of the anchor, since it is integrally and substantially singularly formed, are correspondingly less than for conventional earth anchors.

Having thus described the invention, what is claimed and desired to be secured by letters patent is:

1. An integral earth anchor for use with a drive tool for embedding the anchor within the ground, the earth anchor designed through stress analysis for determination of its shape, size, and thickness, said earth anchor resisting tensile or compressive forces tending to urge it from its embedded position comprising:

a hub body having a rectangular base plate;

a hub extending vertically upwardly from the upper surface of the base plate and adapted for non-driving engagement to a rod of a drive tool, the hub being circular in cross-section with the center line of the hub corresponding to the centerline of the base plate;

a circumferential rectangular side wall extending upwardly from the outer margin of the base plate and spaced radially outwardly of the hub to form a rectangular sleeve in which a portion of the drive tool is received, the height of the side wall corresponding to the height of the hub;

a shank extending integrally downwardly from the bottom surface of the plate and having a beveled lower edge forming a cutting tip for penetrating the ground, the shank extending downwardly from the base plate at an angle to the center line thereof, disposing its beveled cutting edge outwardly from the anchor centerline to effect a shifting of rock and dirt outwardly to provide an opening to enhance the penetration of the anchor into the ground while reducing any stress generation within the said anchor, the base plate, hub, side wall and shank all being integrally formed in forming a hub body of uniform strength, less subject to stress forces, and of relatively tight dimensional tolerances; and, a blade attachable externally to the hub body.

2. The earth anchor of claim 1 wherein the upper end of the hub is bored and internally threaded for an end of the anchor rod to be threadily received in the hub.

3. The invention of claim 2 and wherein the base plate is rectangular in plan and the side wall forms a quadilateral sleeve into which the portion of the drive tool is received.

4. The invention of claim 3 and wherein the entire hub body of the anchor is formed by one of forging, casting, and welding.

* * * * *